US007032248B1

(12) United States Patent
Gutilla

(10) Patent No.: US 7,032,248 B1
(45) Date of Patent: Apr. 25, 2006

(54) MULTIPURPOSE BABY AND TODDLER BIB

(76) Inventor: Janice Gutilla, 17938 Briole Ct., Jupiter, FL (US) 33478

( * ) Notice: Subject to any disclaimer, the term of this patent is extended or adjusted under 35 U.S.C. 154(b) by 0 days.

(21) Appl. No.: 10/963,232

(22) Filed: Oct. 12, 2004

(51) Int. Cl.
*A41B 13/10* (2006.01)

(52) U.S. Cl. ..... 2/49.1

(58) Field of Classification Search ..... 2/49.1, 2/49.2, 49.3, 49.4, 49.5, 48, 51, 52, 50, 46, 2/75, 80, 102, 94, 111; 248/102, 104, 103; D2/861–864
See application file for complete search history.

(56) References Cited

U.S. PATENT DOCUMENTS

| | | | | | |
|---|---|---|---|---|---|
| 2,754,532 | A | * | 7/1956 | Kanehl et al. | 15/209.1 |
| D232,058 | S | * | 7/1974 | Palomares | D3/229 |
| 3,879,762 | A | * | 4/1975 | Herman | 2/48 |
| D242,503 | S | * | 11/1976 | Derifield | D2/864 |
| 4,068,313 | A | | 1/1978 | Goldman | |
| 4,473,907 | A | * | 10/1984 | Maillard | 2/48 |
| 4,564,957 | A | | 1/1986 | Scharf | |
| 4,604,758 | A | | 8/1986 | Grasberger et al. | |
| 4,719,650 | A | | 1/1988 | Milloy | |
| 4,735,423 | A | * | 4/1988 | Foss | 280/18 |
| D300,281 | S | * | 3/1989 | Coates | D2/863 |
| D326,918 | S | | 6/1992 | Roberts | |
| 5,201,073 | A | | 4/1993 | Spanier | |
| 5,312,282 | A | * | 5/1994 | Cooper | 446/27 |
| 5,765,225 | A | * | 6/1998 | Goeckeritz et al. | 2/49.1 |
| 5,815,834 | A | * | 10/1998 | Bronson | 2/102 |
| 5,820,084 | A | | 10/1998 | Trumbauer et al. | |
| 5,960,471 | A | * | 10/1999 | Burton | 2/48 |
| 6,055,667 | A | | 5/2000 | Jimenez | |
| 6,374,411 | B1 | * | 4/2002 | Duhn | 2/49.1 |
| 6,442,759 | B1 | | 9/2002 | Straham, Jr. et al. | |
| 6,745,399 | B1 | * | 6/2004 | Austin | 2/49.1 |
| 6,961,961 | B1 | * | 11/2005 | Ezra | 2/49.1 |
| 2004/0164107 | A1 | * | 8/2004 | Anderson | 224/148.6 |
| 2005/0091723 | A1 | * | 5/2005 | Niederhofer | 2/49.1 |
| 2005/0132462 | A1 | * | 6/2005 | Archambault | 2/48 |

* cited by examiner

*Primary Examiner*—Amy B. Vanatta
(74) *Attorney, Agent, or Firm*—McHale & Slavin PA

(57) ABSTRACT

Various embodiments of a multipurpose baby bib for holding a baby beverage container, and securing thereto a pacifier and/or a teething device. The bib has a main body panel having the upper end of one or more straps releasably attached to the main body panel and a lower end formable into a releasable loop for engaging a pacifier and/or teething device. A lower end of the main body panel is formed into a bottle holding configuration. Alternatively, a bottle holding structure is provided for releasable attachment to the front surface of the bib.

5 Claims, 4 Drawing Sheets

MULTIPURPOSE BABY AND TODDLER BIB

FIELD OF THE INVENTION

The present invention relates generally to baby accessories. More particularly, the present invention relates to a multipurpose baby bib for use in combination with a pacifier, a teething ring, a baby bottle and/or a beverage sipping cup.

DESCRIPTION OF THE PRIOR ART

It is well known that babies and toddlers in the development stage have a tendency to drop or throw down, among other things, their bottles, pacifiers, teething rings, and similar articles. This means that someone monitoring the child must continually retrieve the dropped or thrown object and, in the case of implements that go in the child's mouth, clean the implement before its return. In certain circumstances, e.g., while driving, it may not be possible to retrieve and/or clean the implement.

Various articles have been developed for aiding in securing such implements. However, existing articles generally suffer from one or more limitations or drawbacks, leaving room for improvement.

U.S. Pat. No. 4,564,957 discloses a baby bottle security garment in which one end of a pair of elongated straps are attached to a vest or sleeveless jacket, and an opposite end of the straps are attached to a baby bottle retaining sleeve. A sleeve retaining assembly, including an elongated belt, is further provided to firmly position the bottle in an upright manner against the chest of an infant. The garment incorporates a relatively complex structure that would be expensive to manufacture and would not lend itself to being easily washed. Additionally, the garment incorporates straps, a belt, and like structures that could pose a safety risk to infants and young children. Furthermore, the garment does not provide means for retaining a pacifier, a teething device, or like accessories thereto.

U.S. Pat. No. 6,442,759 discloses a strap having snaps at one end for enabling attachment of the strap to the neck portion of a bib, and an opposite strap end configured for attachment to a teethers, rattles, pacifiers, or toys. The '759 patent does not disclose means for holding a baby bottle or toddler beverage cup. Additionally, the strap mechanism is limited in that it is only adapted for holding one of the aforementioned devices at a time. Furthermore the upper end of the strap is attached to the neck portion in such a manner that it could rub against the neck and/or chest of an infant causing irritation of the skin.

U.S. Pat. Nos. D326,918; 4,068,313; 4,604,758; 4,719,650; and 5,201,073 are exemplary of other bibs having adapted for holding or retaining a baby bottle or accessory. Each of these patents suffers from one or of the aforementioned limitations, drawbacks and disadvantages.

Accordingly, there is a well-established need for a multifunctional bib overcoming the aforementioned limitations, drawbacks and disadvantages of the prior art.

SUMMARY OF THE INVENTION

The invention is directed to a wearable article that can be easily donned, and subsequently removed, about the neck of a baby or toddler, which functions to protect underlying clothing as well as to secure a bottle, or other child beverage container, along with various baby accessories, such as a pacifier and teething ring, directly to the wearable article to prevent the same from being purposely thrown, or inadvertently dropped, to the ground. The article has a construction that is comfortable to wear, easy to clean, and inexpensive to manufacture.

In one general embodiment of the present invention, a multipurpose bib is provided comprising: a flexible main body panel having integral upper, central and a lower panel portions; a strap having an upper end removably attached to the main body panel, and a lower end that can be secured to itself to selectively form a loop for securing a baby accessory thereto. The main body panel upper portion forms a collar adapted for being releasably secured about the neck of a child, and lower portion of the main body panel is formed into a bottle-holding configuration.

In one aspect of the invention, the bottle-holding portion is configured into a form having a bottom, rear, left and right sides, and incorporates elastic bands extending across its front and adjoining the left and right sides. The sides and the elastic band(s) cooperate to define an interior space adapted for receiving and snugly-engaging a baby bottle, such that the bottle is maintained in a position where it can be easily moved by the baby toward his/her mouth without requiring removal from the bottle-holding portion of the bib.

In a further aspect of the invention, the collar is comprised of a pair of distal ends which wrap around the back of the child's neck and incorporate means, such as a hook-and-loop fastening system, for releasable attachment.

In a second general embodiment of the present invention, a multipurpose bib is provided comprising: a flexible main body panel having integral upper, central and a lower panel portions; a strap having an upper end releasably attached to the said main body panel, and a lower end adapted for forming a releasable loop, the main body panel upper portion forming a collar adapted for being releasably secured about the neck of a child, the main body panel lower portion having a narrow rectangular-shaped configuration depending downwardly from the central panel portion and having releasable attachment means disposed on a front surface thereof; and a child beverage container holding apparatus having means for being releasably attached to a front surface of said main body panel lower portion.

In a further aspect of the invention, the beverage container holding apparatus is comprised of: a flexible panel formed into a configuration comprised of a rear side, left and right sides, and a bottom side extending between and adjoining said left and right sides; at least one elastic band extending between and adjoining vertically oriented forward edges of the left and right sides; and attachment means disposed on a rear surface of said rear side for releasable attachment to the front surface of the main body panel lower portion. The left, right, rear and bottom sides of said beverage container holding apparatus cooperate with said at least one elastic band to define an interior space adapted for receiving and snugly-engaging a baby bottle.

In yet a further aspect of the invention, the bib incorporates a flap extending downwardly from a bottom end of the lower portion of the main body panel, and attachment means on a front surface of the flap, enabling releasable attachment to the corresponding releasable attachment means disposed on the front surface of the lower panel portion. Attachment of the flap to the lower panel portion, by bending the flap back onto itself, causes formation of the flap into a releasable loop particularly adapted for securing a handle portion of a baby teething ring thereto.

In a third general embodiment of the present invention, a multifunctional bib is provided comprising: a primary generally rectangular panel of fabric having a circular opening provided proximate to an upper end thereof; a secondary generally rectangular panel of fabric having left, right and bottom edges fastened to a front surface of the primary panel adjacent to a lower end thereof, the secondary panel having a central slot, or cutout, extending vertically from an upper edge thereof; and at least one elastic band extending across and adjoining left and right edges of the central slot. The primary and secondary fabric panels cooperate with the elastic band(s) to define an interior space adapted for receiving and snugly-engaging a baby beverage container. Preferably, a pacifier strap is provided releasably attachable to the primary bib panel.

In a fourth general embodiment of the present invention, a multifunctional bib is provided comprising: a primary panel of fabric having a narrow rectangular-shaped main body portion extending downwardly from an upper annular-shaped collar portion; a secondary generally rectangular panel of fabric having left, right and bottom edges fastened to a front surface of the primary panel adjacent to a lower end thereof to form a pocket, the secondary panel having a central slot extending vertically from an upper edge thereof; and at least one elastic band extending across and adjoining left and right edges of the central slot. The primary and secondary fabric panels cooperate with the elastic band(s) to define an interior space sized and shaped for receiving and snugly-engaging a baby beverage container. Preferably, the lower edges of the primary and secondary panels align, or overlie one another, and the left and right edges of the secondary panel align with, or overlie, the lower end portions of left and right edges of the primary panel.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed to a multifunctional, wearable article that can be easily donned, and subsequently removed, about the neck of a baby or toddler, which functions to protect underlying clothing as well as to secure a bottle, or other child beverage container, along with various baby accessories, such as a pacifier and teething ring, directly to the wearable article to prevent the same from being purposely thrown, or inadvertently dropped, to the ground.

Figure 1:
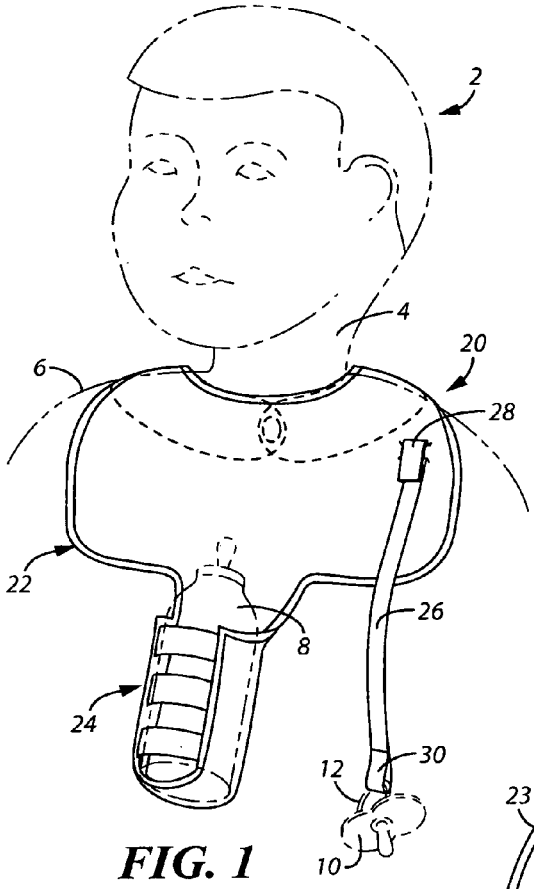
FIG. 1 is a front perspective view of a multipurpose baby bib (shown donned around the neck of a baby and carrying a bottle and a pacifier) in accordance with a first embodiment of the present invention.
Figure 2:
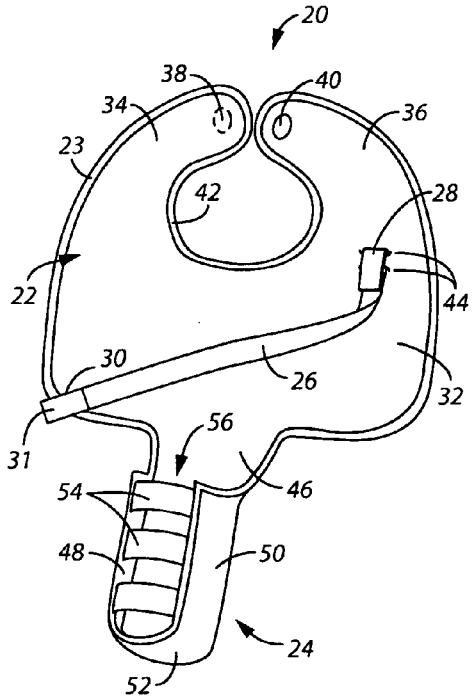
FIG. 2 is a front perspective view of the multipurpose bib of FIG. 1 shown laid out, with the bottle and pacifier removed.

Referring initially to FIGS. 1 and 2, the bib is shown in accordance with a first general embodiment of the invention. In FIG. 1, the bib 20 is shown being worn about the neck 4 and shoulders 6 of a child 2. In FIG. 2, the bib 20 is shown removed from the child 2 and laid open to expose the entire bib structure. Preferably, the bib 20 has a main body 22 generally comprised of a central portion 32 separating a relatively narrower, or reduced width, lower bib portion 56, and upper left collar 23 and right collar 36 portions. As will be apparent to those skilled in the art, the main body of the bib can be constructed from any of variety of well-known materials. Preferably, the bib is composed of woven cloth fabric, such as a standard quilting or terrycloth that is soft, durable and flexible. The bib may be constructed from a pair of superimposed layers of material (cotton, synthetic or combination thereof) cut to the desired shape and attached by peripheral stitching 23, 42. Preferably, the main body 22 includes at least one waterproof layer (not shown) to prevent seepage of liquids though the main body. As will be apparent to those skilled in the art, one or more waterproof material layers can be provided on an exterior of the main body or, alternatively, interposed between absorbent layers. The left and right collar portions, 23 and 36, respectively, each have a generally C-shape, together forming a collar seam portion 42 having a size slightly larger than the child's neck 4. Fastening means, such complementary halves of a hook-and-loop fastening system 38, 40 (e.g., those commonly sold under the trade name VELCRO) are provided disposed at the distal ends of the collar portions 23, 36 for enabling releasable attachment about the child's neck 4. In lieu of a hook-and-loop type fastener system, conventional fastening means, such as snaps or cords, can be employed without departing from the scope of the invention.

The lower narrowed portion 46 of the main body 22 is formed into a bottle holding portion 24, including a left side 48, a right side 50 and a bottom side 52. One or more elastic bands 54 span the front edges of the respective left and right sides, 48, 50, and are sewn or otherwise attached thereto. Together, sides 46, 48, 50 and 52, along with elastic bands 54, define an interior space 56 sized, shaped and otherwise configured for snugly receiving, and frictionally maintaining, a baby bottle therein. Significantly, the bottle retaining portion 24 is oriented, positioned and shaped, such that it can be easily manipulated by a baby, with minimal effort, toward the baby's mouth as desired. Significantly, incorporating a lower portion 24 that is considerably narrowed, vis-á-vis the central portion 32 of the bib main body 22, facilitates grasping of the bib material by a child in order to raise the bottle 8 toward his or her mouth, without having to remove the bottle from the lower portion 24. The frictional force provided by the elastic bands 54 is adequate to prevent removal of the bottle by a baby, thereby avoiding throwing or dropping of the bottle onto the ground.

A non-elastic strap 26 is provided for the purpose of maintaining attachment of a pacifier 10 to the main body 22 of the bib 20. In particular, an upper end 28 of the strap is configured for releasable attachment to the main body 22 of the bib 20, and an opposite lower strap end 30 is configured for releasable attachment to a pacifier. In the illustrated preferred embodiment, both the upper and lower strap ends incorporate hook-and-loop type fastener systems, shown generally as reference numeral 31, to enable the ends to be folded back onto themselves to form a contiguous loop. The upper end 28 is preferably looped through a pair of slits 44 provided in the bib body 22, while the lower end 30 is extended through a closed handle portion 12 of the pacifier 10.

Figure 3:
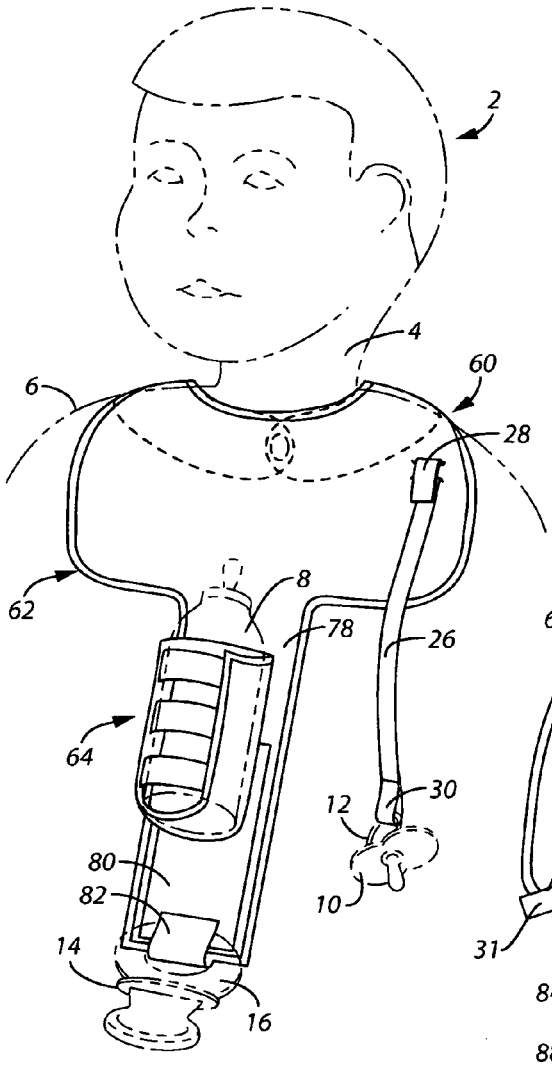
FIG. 3 is a front perspective view of a multipurpose baby bib (shown donned around the neck of a baby and carrying a bottle and a teething device) in accordance with a second embodiment of the present invention.
Figure 4:
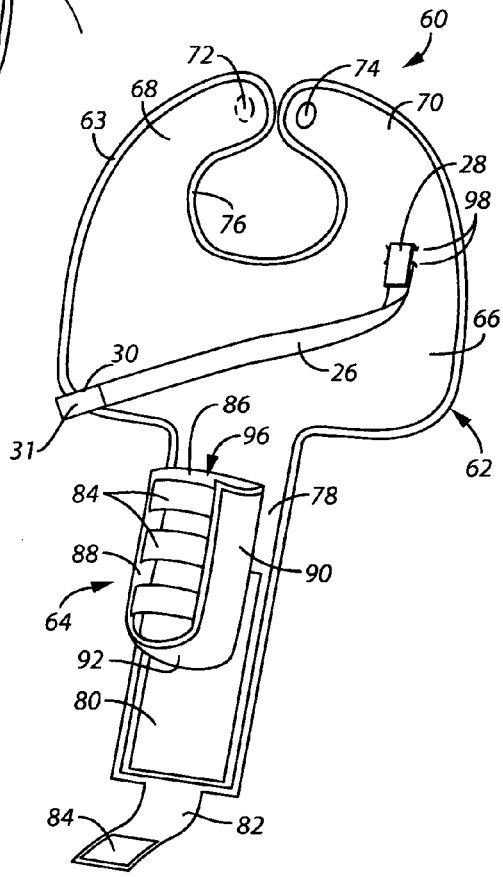
FIG. 4 is a front perspective view of the multipurpose bib of FIG. 3 shown laid out, with the bottle and teething device removed.

Referring now to FIGS. 3 and 4, in a second general embodiment of the present invention, a bib 60 is provided having a removably attachable child beverage container portion 64, as well as a teething device attachment structure 26. The bib 60 includes a main bib main body 62 having a central portion 66, left and right collar portions, 68 and 70 (having fastening means 72, 74), a peripheral seam 63, 76, and a strap 26 having an upper end 28 extending through slits 98, as heretofore described with reference to FIGS. 1 and 2.

A generally rectangular reduced width, or narrowed, lower bib panel portion 78 extends downwardly from central portion 66, and includes a fastening area 80 which preferably comprises one-half of a hook and loop type fastening system. A flap 82 extending down from the lower end of portion 78 is provided having a fastening area 84, preferably comprising the other half of a hook-and-loop type fastening system for releasable attachment to fastening area 80. In use, flap 82 is extended through a closed handle portion 16 of a teething device 14 and then attached to fastening area 80 to secure the teething device to the main body 62 of bib 60.

A baby beverage container-holding structure 64 is provided for releasable attachment to fastening area 80. The container-holding structure can be fabricated from any of a variety of well know materials. However, it is preferred that the container-holding structure 64 is fabricated from a material similar, if not identical, to the fabric used to construct the bib body 62. Structure 64 includes rear side 86, left side 88, right side 90 and bottom side 92. One or more elastic bands 84 are provided spanning, and secured to, left and right sides, 88 and 90, in the same manner as heretofore described with reference to FIGS. 1 and 2. The rear surface (not visible) of rear side 86 has disposed thereon fastening means (not shown) cooperating with fastening means 80 to enable releasable attachment of the bottle holder 64 thereto.

Figure 5:
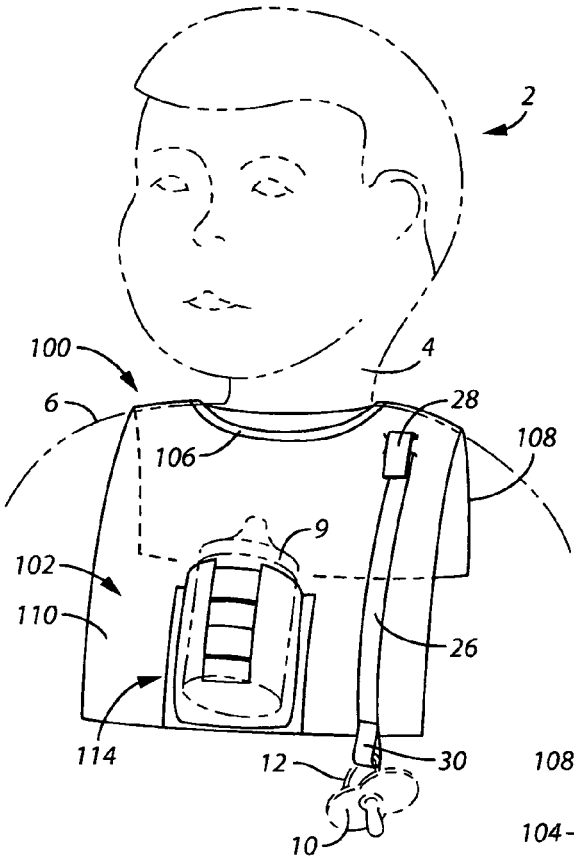
FIG. 5 is a front perspective view of a multipurpose baby bib (shown donned about the neck of a baby and carrying a sipping cup and a pacifier) in accordance with a third embodiment of the present invention.
Figure 6:
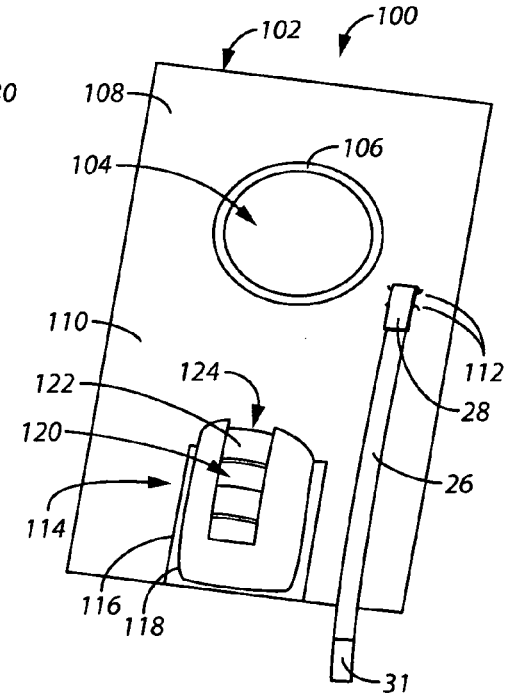
FIG. 6 is a front perspective view of the multipurpose bib of FIG. 5 shown laid out, with the sipping cup and pacifier removed.

Referring now to FIGS. 5 and 6, in a third embodiment of the invention, a multipurpose bib, shown generally as reference numeral 100, includes a rectangular flexible fabric primary panel 102, having a generally circular collar 106 surrounding a head-receiving opening 104. When donned on a child, a rear portion 108 of the panel 102 extends behind the neck 4 of the child 2, and a front portion 110 extends forward of the child's neck to function as a bib to protect the underlying clothing. A smaller secondary fabric panel 114 is secured to the lower end of front portion 110, by exterior stitching 116 and interior stitching 118, to form a pocket-style structure. One or more elastic bands 122 are provided spanning a cutaway section, or central slot 120, in order to facilitate stretching of the pocket to cause frictional engagement of the pocket against a beverage container 9, such as those commonly referred to as "Sippy Cups," seated within interior space 124. Preferably, a strap 26 is provided secured at one end, through slits 112, to the bib, and configured for attachment to a pacifier 10, as heretofore described with reference to FIGS. 1 and 2.

Figure 7:
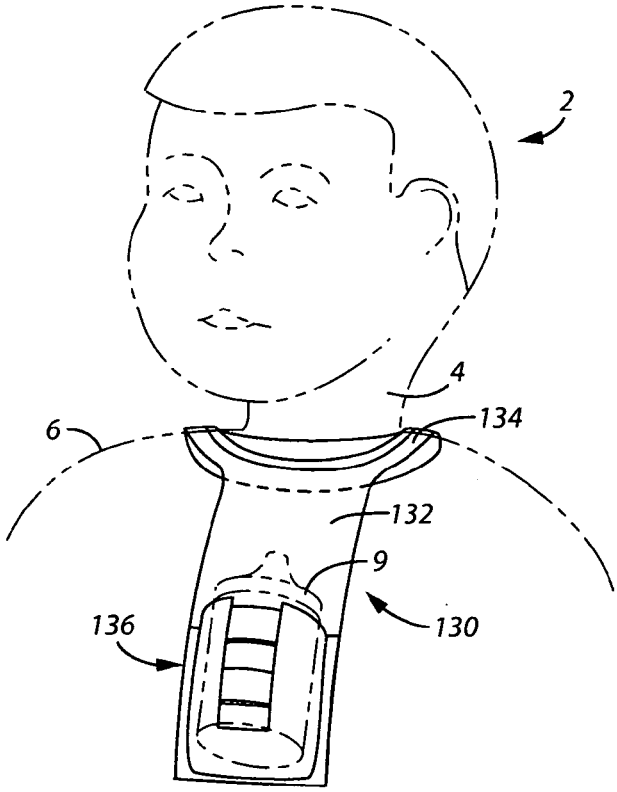
FIG. 7 is a front perspective view of a sipping cup support bib (shown donned about the neck of a toddler and carrying a sipping cup) in accordance with a fourth embodiment of the present invention.
Figure 8:
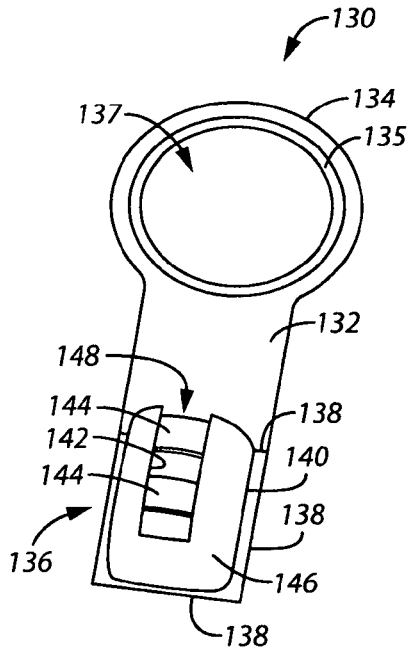
FIG. 8 is a front perspective view of the support bib of FIG. 7 shown laid out, with the sipping cup removed.

Referring now to FIGS. 7 and 8, in a fourth general embodiment of the present invention, a multipurpose bib, shown generally as reference numeral 130 includes a primary fabric panel, comprised of a flexible annular-shaped collar portion 134, 135 defining a head-receiving opening 137, having a generally rectangular main body portion 132 extending downwardly therefrom. A secondary fabric panel 140 is provided fastened to the lower end of main body portion 132, in the configuration of a pocket, shown generally as reference numeral 136, for holding a "Sippy Cup," or like beverage container, within an interior space 148 thereof. The secondary fabric panel 140 is preferably attached to the primary fabric panel 132 by exterior (peripheral) stitching 138 and interior stitching 140. Furthermore, one or more elastic bands 144 are provided spanning a cutaway section, or central slot 142, in a like manner, and for purposes, heretofore described with regard to FIGS. 5 and 6.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A multipurpose bib, comprising:

a flexible main body panel having integral upper, central and lower panel portions, said central panel portion including a pair of parallel slits therein;

a strap sized for insertion into said pair of slits having an upper end and a lower end each including mated portions of hook and loop fastening material positioned for forming a releasable loop wherein said strap can be inserted through said slits and formed into said releasable loop whereby said strap is releasably attached to the main body panel;

said main body panel upper portion forming a collar adapted for being releasably secure about the neck of a child; and said main body panel lower portion being relatively narrower than said central portion and formed in to a bottle-holding configuration including a rear side, left and right sides and a bottom side extending between and adjoining said left and right sides and at least one elastic band extending between and adjoining vertically oriented forward edges of said left and right sides, said at least one elastic band cooperating with said rear, left and right sides to define an interior space adapted for receiving and snugly-engaging a baby bottle.

2. A multipurpose bib as recited in claim 1, wherein said collar further comprises distal end portions having releasable attachment means for securing said collar about the neck of a child.

3. A multipurpose bib as recited in claim 2, wherein said releasable attachment means comprises portions of hook and loop fastening material.

4. A multipurpose bib as recited in claim 1, wherein said main body panel comprises a waterproof liner of vinyl.

5. A multipurpose bib as recited in claim 1 wherein said main body panel is formed from quilted material.

* * * * *